US005513416A

United States Patent [19]

Bassler et al.

[11] Patent Number: 5,513,416

[45] Date of Patent: May 7, 1996

[54] WALL-MOUNTED HOLDER FOR A TANK-TYPE VACUUM CLEANER AND ATTACHMENTS

[75] Inventors: Louis M. Bassler, Montoursville; Robert C. Berfield, Jersey Shore, both of Pa.

[73] Assignee: Shop Vac Corporation, Williamsport, Pa.

[21] Appl. No.: 243,983

[22] Filed: May 17, 1994

[51] Int. Cl.[6] ..... A47F 5/08

[52] U.S. Cl. ..... 15/323; 15/327.5; 211/88

[58] Field of Search ..... 15/323, 327.5; 211/60.1, 65, 88, 87

[56] References Cited

U.S. PATENT DOCUMENTS

| | | | |
|---|---|---|---|
| D. 159,960 | 9/1950 | Davey | 15/323 |
| D. 159,961 | 9/1950 | Davey | 15/323 |
| D. 177,717 | 5/1956 | Conrad | D33/3 |
| D. 203,010 | 11/1965 | Graham et al. | D58/26 |
| D. 231,168 | 4/1974 | Hammett | D6/136 |
| D. 288,015 | 1/1987 | Verdier et al. | D32/18 |
| D. 289,631 | 5/1987 | Osit | D13/5 |
| 1,551,434 | 8/1925 | Shiffer | 211/87 |
| 2,386,489 | 10/1945 | McKellar | 15/323 |
| 2,467,997 | 4/1949 | Sheker | 15/323 |
| 2,506,897 | 5/1950 | Sheker | 15/323 |
| 2,528,872 | 11/1950 | Dick | 15/323 |
| 2,595,752 | 5/1952 | Batts | 15/323 |
| 2,615,577 | 10/1952 | Bartleman | 211/60 |
| 2,854,686 | 10/1958 | Hansen | 15/323 |
| 3,095,092 | 6/1963 | Magarian | 211/60 |
| 3,187,902 | 6/1965 | Nelson | 211/60 |
| 3,627,248 | 12/1971 | Nelson | 248/309 |
| 3,672,616 | 6/1972 | Hunt | 248/75 |
| 3,812,976 | 5/1974 | Rempel | 211/60 T |
| 3,872,538 | 3/1975 | Crouser | 15/323 |
| 3,942,669 | 3/1976 | Savage, Jr. | 220/18 |
| 4,118,002 | 10/1978 | Bartlett | 248/311.1 R |
| 4,155,459 | 5/1979 | Marschak | 211/49 R |
| 4,270,722 | 6/1981 | Batchelder | 248/310 |
| 4,294,421 | 10/1981 | Kunstlicher et al. | 248/37.6 |
| 4,453,690 | 6/1984 | Takeuji | 248/309.1 |
| 4,645,150 | 2/1987 | Taylor | 248/56 |
| 4,672,703 | 6/1987 | Frazier | 5/503 |
| 4,746,092 | 5/1988 | Hayashi et al. | 248/638 |
| 4,895,334 | 1/1990 | Bajek et al. | 248/302 |
| 5,029,792 | 7/1991 | Desjardins | 248/309.1 |
| 5,071,012 | 12/1991 | Jailor | 211/13 |
| 5,195,595 | 3/1993 | Nakagawa | 169/51 |

FOREIGN PATENT DOCUMENTS

| | | |
|---|---|---|
| 406244 | 2/1934 | United Kingdom . |
| 497014 | 12/1938 | United Kingdom . |
| 1447396 | 8/1976 | United Kingdom . |
| 2042326 | 9/1980 | United Kingdom . |
| 2104772 | 3/1983 | United Kingdom . |

*Primary Examiner*—David Scherbel
*Assistant Examiner*—Tony G. Soohoo
*Attorney, Agent, or Firm*—Marshall, O'Toole, Gerstein, Murray & Borun

[57] ABSTRACT

A holder for a tank-type vacuum cleaner and attachments includes a first bracket for receiving a tank-type vacuum cleaner thereon, the first bracket being mountable to a surface, and a second bracket separate from but matingly engageable with the first bracket for receiving at least one vacuum cleaner attachment. The first and second brackets may be matingly engaged or the two brackets may be mounted to a wall separately from one another in a two-piece configuration.

16 Claims, 5 Drawing Sheets

WALL-MOUNTED HOLDER FOR A TANK-TYPE VACUUM CLEANER AND ATTACHMENTS

TECHNICAL FIELD

The present invention relates generally to vacuum cleaner holders and more particularly to a wall-mounted holder for a tank-type vacuum cleaner and vacuum cleaner attachments.

BACKGROUND ART

Tank-type vacuum cleaners are available in a variety of sizes from very large floor-standing units to small portable ones. Larger models are typically equipped with wheels for rolling the units and are generally stored on a floor when not in use. Smaller units may be stored on a floor but are also suitable for storage on a shelf along with vacuum cleaner attachments which are separate from the vacuum cleaner.

Previously, hand-held, miniature, cordless vacuum cleaners (i.e., non-tank units), such as the Black and Decker Dustbuster®, have been provided with a wall-mountable recharging base for recharging and storage of the vacuum cleaner. However, no similar bracket is known to have been provided with a portable tank-type vacuum cleaner in order to reduce the cluttering of shelf space associated with storage of a tank-type vacuum cleaner and related vacuum cleaner attachments.

SUMMARY OF THE INVENTION

In accordance with one aspect of the present invention, a holder for holding a portable tank-type vacuum cleaner includes means for securing the holder to a wall or other surface and a main portion coupled to the securing means and having walls defining a cavity configured to substantially conformingly receive a tank-type vacuum cleaner therein.

The cavity may be further defined by the securing means, and the latter may include a mounting wall having a hole for receiving a mounting screw which may be provided for securing the mounting wall to a surface.

The holder may further include means for retaining at least one vacuum cleaner attachment. The retaining means preferably includes one or more sets of at least two coaxial rings for holding one or more vacuum cleaner attachments. Each such ring set is sized to frictionally engage a vacuum cleaner attachment to retain such attachment therein regardless of the orientation of the retaining means.

Moreover, the main portion preferably includes an annular seat configured to removably receive the retaining means in a particular orientation.

In accordance with another aspect of the present invention, a holder includes means for securing the holder to a wall or other surface and means coupled to the securing means for retaining a vacuum cleaner attachment.

In accordance with yet another aspect of the present invention, a holder includes first means for receiving a tank-type vacuum cleaner thereon, the first receiving means having means for mounting the first receiving means to a surface, and second means separate from but matingly engageable with the first receiving means for receiving at least one vacuum cleaner attachment.

DESCRIPTION OF THE PREFERRED EMBODIMENTS

Figure 1:
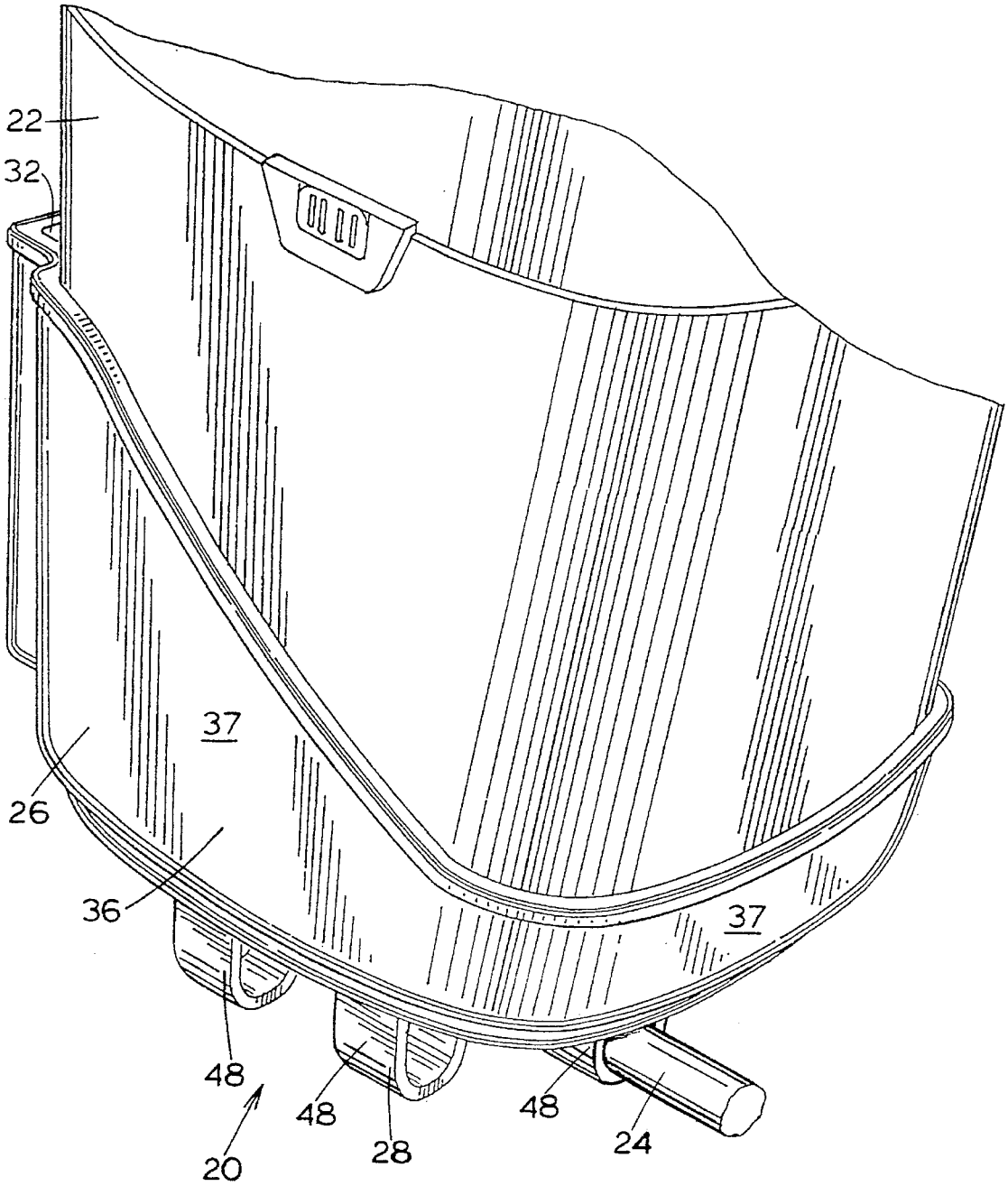
FIG. 1 comprises a perspective view of a holder in accordance with the present invention having a fragmentary tank-type vacuum cleaner and a fragmentary vacuum cleaner attachment disposed therein.

Referring initially to FIG. 1, a holder 20 according to the present invention for holding a portable, tank-type vacuum cleaner 22 and associated vacuum cleaner attachments 24 includes a first bracket 26 and a second bracket 28.

Figure 2:
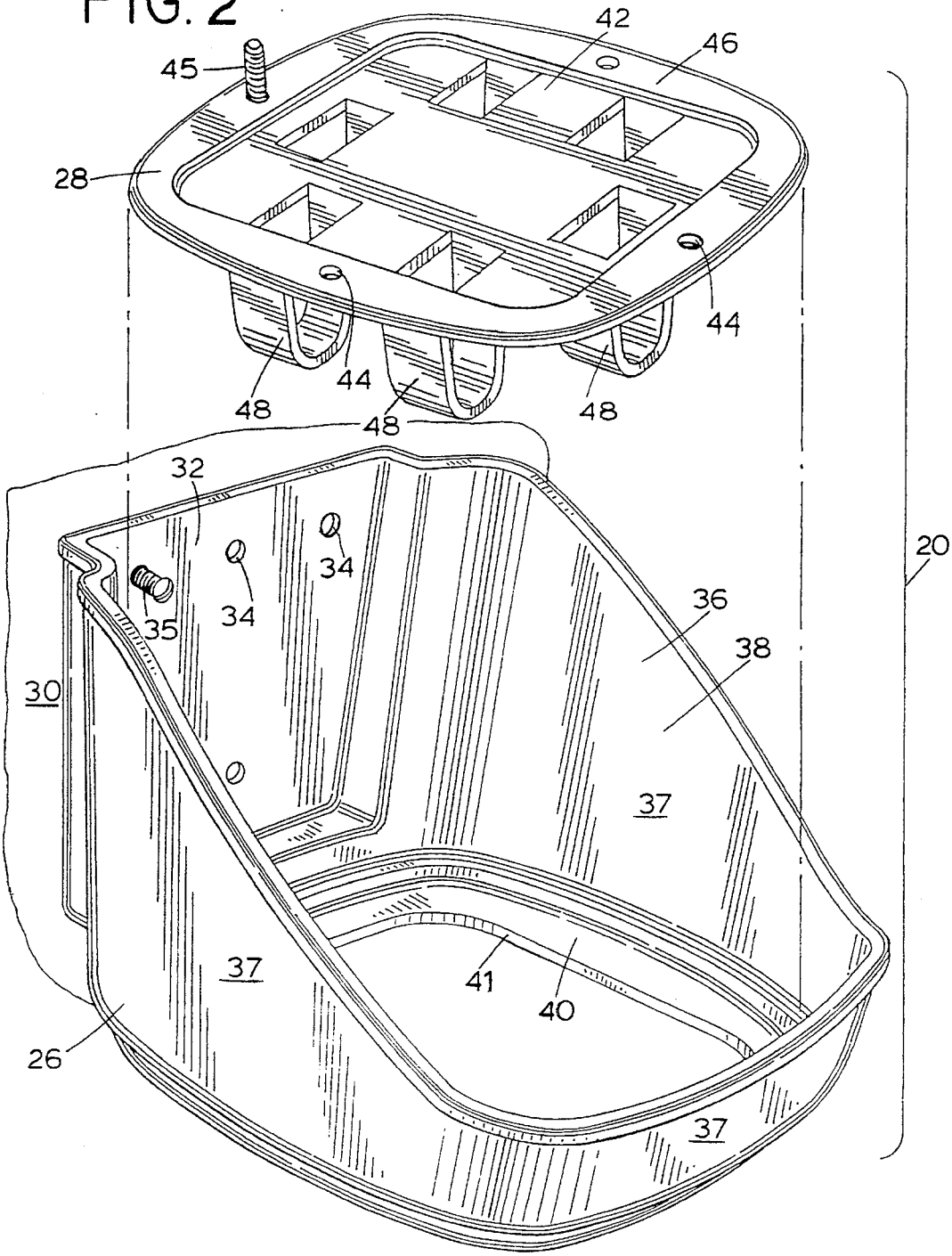
FIG. 2 comprises an exploded perspective view of the vacuum cleaner portion and the attachment portion of the holder of FIG. 1.

Referring now to FIG. 2, the second bracket 28 is matingly engageable with, but may be removed from, the first bracket 26. As noted in greater detail hereinafter, the first bracket 26 and the second bracket 28 may be mounted on a wall or other surface 30 independently of one another or the second bracket 28 may be removably placed within and received by the first bracket 26.

Figure 3:
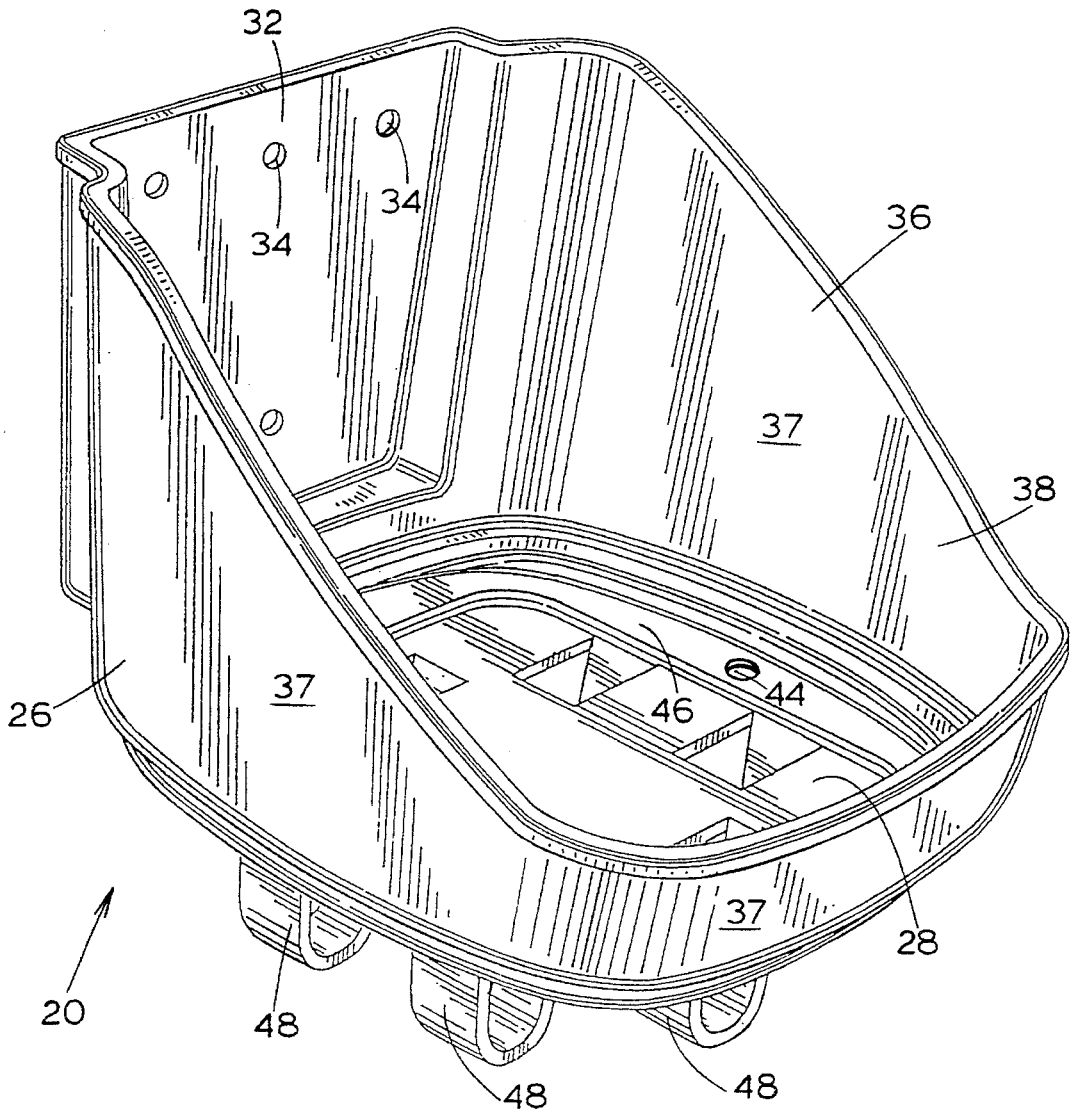
FIG. 3 comprises a perspective view of the holder of FIG. 1.

Referring now to FIGS. 2 and 3, the first bracket 26 includes a first portion or mounting wall 32 having one or more screw holes 34 formed therein for receiving a number of mounting screws 35 which may be used to secure the first bracket 26 to the wall or surface 30.

The first bracket 26 also includes a second portion 36 coupled to the first portion 32. The second portion 36 includes walls 37 at least partially defining a cavity 38 which is configured to substantially conformingly receive a tank-type vacuum cleaner 22 (shown only in FIG. 1) therein. In other words, the cavity 38 is large enough to hold the vacuum cleaner 22 but small enough to prevent appreciable movement of the vacuum cleaner 22 in a lateral direction as shown in FIG. 1. As shown, at least part of the first portion 32 is spaced from the cavity 38 so that the cavity 38 is primarily defined by the walls 37 of the second portion 36. However, the first portion 32 could further define the cavity 38, if desired.

Preferably, although not necessarily, the vacuum cleaner 22 comprises a hand-held wet/dry vacuum cleaner sold by Shop Vac Corporation of Williamsport, Pa., under the trademark 1×1. An example of such a vacuum cleaner is shown in United States application Ser. No. 08/132,389, the disclosure of which is hereby incorporated herein by reference.

Figure 4:
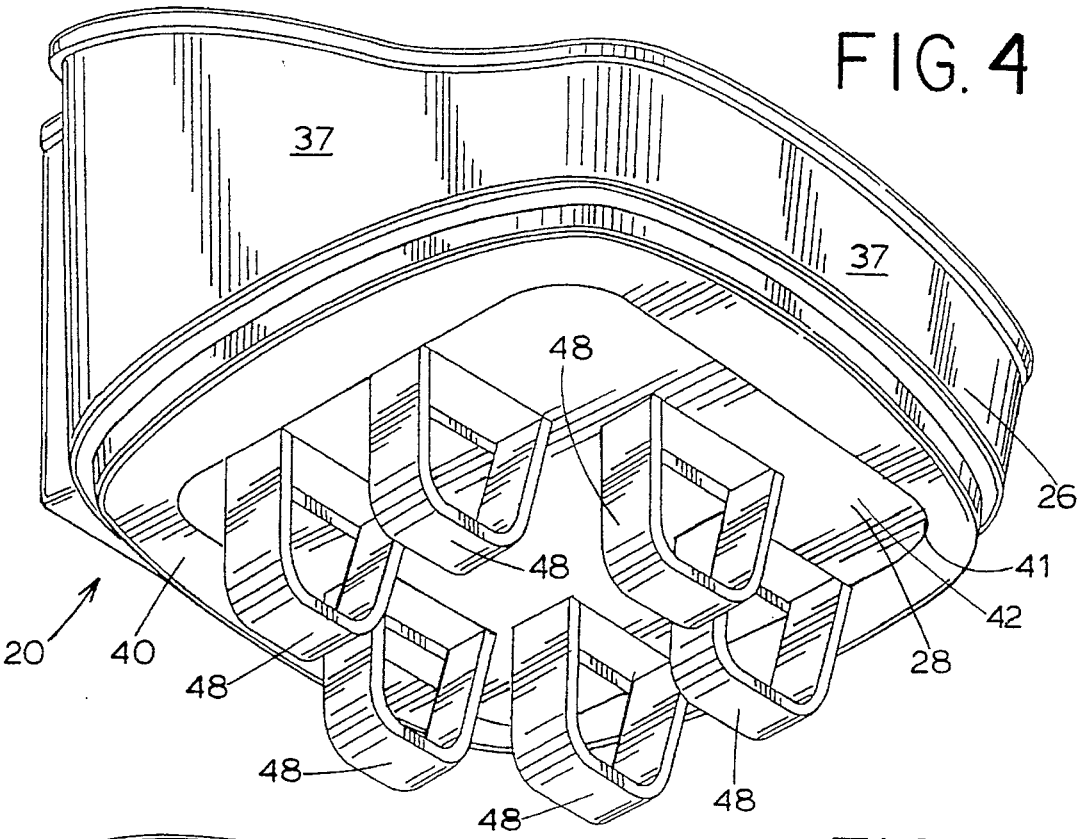
FIG. 4 comprises a perspective view of the holder of FIG. 1 with the attachment bracket shown in a first orientation.
Figure 5:
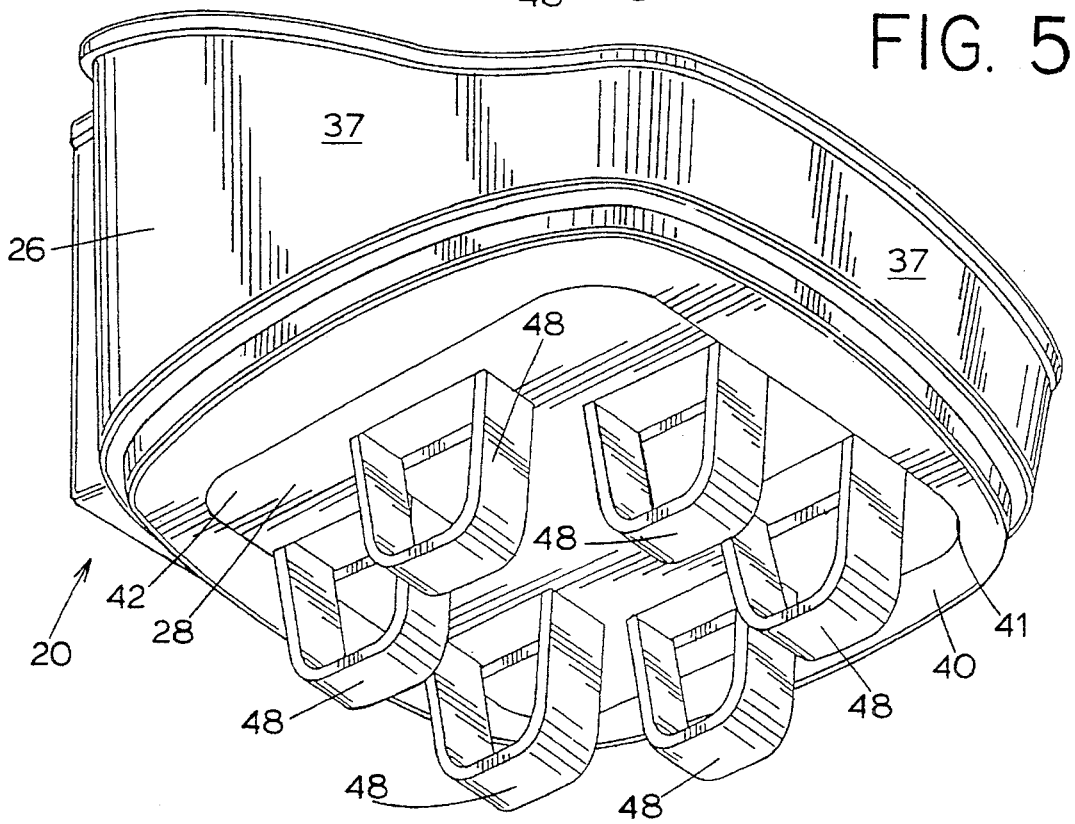
FIG. 5 comprises a perspective view of the holder of FIG. 1 with the attachment bracket shown in a second orientation.

The first bracket 26 includes an annular seat 40 surrounding an opening 41 and defined at least in part by one of the first and second portions 32, 36. The annular seat 40 and the opening 41 are sized and shaped so that the second bracket 28 may be seated on the seat 40 and matingly engaged therewith (as best shown in FIGS. 3–5). The first bracket 26 may be provided with a shelf or otherwise adapted for holding a vacuum cleaner hose, extension cord, or other accessories.

The second bracket 28 may be seated on the annular seat 40 in any of four perpendicular orientations (two of which are shown in FIGS. 4 and 5). It should be noted that, if desired, the second bracket 28 may be designed to be seated on the annular seat 40 in any appropriate number of orientations, and that those orientations may, but need not, be perpendicular.

Referring again to FIG. 2, the second bracket 28 includes a main portion 42 having one or more screw holes 44 formed therein for receiving a number of screws 45 which may be used to secure the second bracket 28 to a wall or surface 30, if desired. The main portion 42 of the second bracket 28 includes a flange 46 which is adapted for mating engagement with the annular seat 40 of the first bracket 26 when the first and second brackets 26, 28 are matingly engaged with one another as shown in FIGS. 1 and 3–5.

The second bracket 28 also includes three sets of two (or more) coaxial straps or rings 48 or other suitable holding means integral with or coupled to the main portion 42 for retaining up to three vacuum cleaner attachments 24 (one of which is shown in FIG. 1). Preferably, but not necessarily, the rings 48 of each set are of equal cross-sectional dimensions. Also, rather than being rigid and circular, the rings 48 may be composed of a flexible or elastic material so that they can conform to the shape of any vacuum cleaner attachment 24. Further, rigid rings 48 need not be continuous as shown in FIGS. 1–5. Instead, the rings 48 may comprise a pair of rigid ring portions (not shown) which cooperate to retain an attachment 24. In any event, each ring 48 is sized to frictionally engage a vacuum cleaner attachment 24 to retain the attachment 24 regardless of the orientation of the rings 48.

Figure 6:
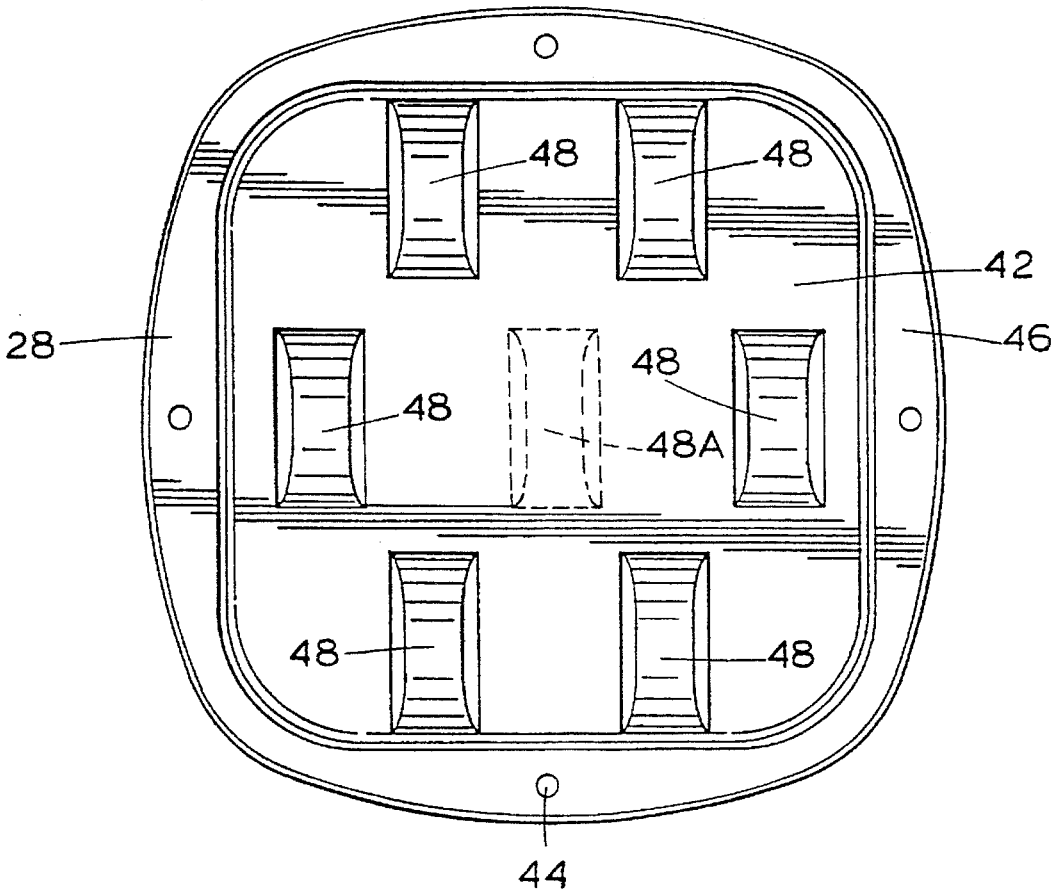
FIG. 6 comprises a plan view of the attachment bracket.

The rings 48 extend through the opening 41 and downwardly below the seat 40 when the flange 46 is engaged with the annular seat 40. Of course, any other desired number of sets of rings 48 can be provided for holding any desired number of vacuum cleaner attachments 24. Moreover, while the rings 48 of the second bracket 28 are arranged symmetrically as shown in FIGS. 1–5, it will be apparent to those skilled in the art that the rings 48 can be arranged so that the rings of each pair are equally spaced, such as by moving either of the rings 48 of the central pair to the position 48A (shown in FIG. 6). Of course, the rings 48 may be arranged in any convenient manner to facilitate fabrication of the second bracket 28 while maintaining the structural strength thereof.

Rather than being seated on the annular seat 40 of the first bracket 26, the second bracket 28 can be mounted on the wall 30 or any other surface independently of the first bracket 26. In that case, the second bracket 28 can be mounted in any desired orientation for holding one or more vacuum cleaner attachments 24. While the second bracket 28 is completely separable from the first bracket 26, it should be apparent to those skilled in the art that the first and second brackets 26, 28 could be integrally formed or could instead be fastened together in any suitable manner in accordance with the present invention.

The foregoing description is for the purpose of teaching those skilled in the art the best mode of carrying out the invention and is to be construed as illustrative only. Numerous modifications and alternative embodiments of the invention will be apparent to those skilled in the art in view of this description. The details of the disclosed structure may be varied substantially without departing from the spirit of the invention, and the exclusive use of all modifications within the scope of the appended claims is reserved.

What is claimed is:

1. A holder, comprising: means for securing the holder to a surface; and a main portion coupled to the securing means and having wall defining a tank-type vacuum cleaner receiving cavity; and a vacuum cleaner attachment retaining means;

the main portion further including receiving means comprising a marginal seat portion disposed proximate the wall for removably receiving the vacuum cleaner attachment retaining means.

2. The holder of claim 1, wherein the wall is integral with at least a portion of the securing means.

3. The holder of claim 1, wherein the securing means comprises a mounting wall having a hole for receiving a mounting screw.

4. The holder of claim 1, wherein the securing means comprises a mounting wall having a hole for receiving a mounting screw and a mounting screw for securing the mounting wall to a surface.

5. The holder of claim 1, in combination with a vacuum cleaner attachment retaining means.

6. The holder of claim 5, wherein the vacuum cleaner attachment retaining means is removably received by the main portion.

7. The holder of claim 1, wherein the marginal seat portion of the receiving means comprises an annular seat configured to receive the vacuum cleaner attachment retaining means.

8. The holder of claim 7, wherein the vacuum cleaner attachment retaining means includes means for engaging the annular seat in a particular orientation.

9. The holder of claim 1, wherein the vacuum cleaner attachment retaining means includes a ring for holding a vacuum cleaner attachment.

10. The holder of claim 1, wherein the vacuum cleaner attachment retaining means includes means for engaging the main portion in a particular orientation and includes a plurality of rings and wherein each ring defines an opening that is sized so that the ring can frictionally engage a vacuum cleaner attachment to retain such attachment therein regardless of the orientation of the retaining means.

11. A holder, comprising:

first receiving means for receiving a tank-type vacuum cleaner thereon, the first receiving means having a marginal seat portion and mounting means for mounting the first receiving means to a surface; and second receiving means separate from the first receiving means for receiving at least one vacuum cleaner attachment;

said second receiving means including means for removably engaging the marginal seat portion of the first receiving means.

12. The holder of claim 11, wherein the first receiving means includes the mounting means and a cavity-defining wall coupled to the mounting means and at least partially defining a cavity that is large enough to receive a tank-type vacuum cleaner therein but small enough to substantially prevent movement of the vacuum cleaner within the cavity.

13. The holder of claim 11, wherein the second receiving means includes retaining means for retaining a vacuum cleaner attachment and wherein the marginal seat portion of the first receiving means comprises an annular seat configured to receive the second receiving means.

14. The holder of claim 13, wherein the retaining means includes a ring for holding a vacuum cleaner attachment.

15. The holder of claim 13, wherein the retaining means includes a plurality of rings and wherein each ring defines an opening that is sized so that the ring can frictionally engage a vacuum cleaner attachment to retain such attachment therein regardless of the orientation of the retaining means.

16. The holder of claim 13, wherein the second receiving means includes means for engaging the annular seat in a particular orientation.

* * * * *